US009640348B2

(12) United States Patent
Kuo

(10) Patent No.: US 9,640,348 B2
(45) Date of Patent: May 2, 2017

(54) PUSHBUTTON SWITCH

(71) Applicant: Excel Cell Electronic Co., Ltd., Taichung (TW)

(72) Inventor: Yung-Ming Kuo, Taichung (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 79 days.

(21) Appl. No.: 14/867,618

(22) Filed: Sep. 28, 2015

(65) Prior Publication Data

US 2016/0104586 A1 Apr. 14, 2016

(30) Foreign Application Priority Data

Oct. 8, 2014 (TW) ..... 103135030 A

(51) Int. Cl.

| | |
|---|---|
| ***H01H 13/26*** | (2006.01) |
| ***H01H 23/28*** | (2006.01) |
| ***H01H 13/36*** | (2006.01) |
| *H01H 13/52* | (2006.01) |
| *H01H 25/00* | (2006.01) |
| *H01H 3/12* | (2006.01) |
| *H01H 25/04* | (2006.01) |

(52) U.S. Cl.

CPC ..... *H01H 23/28* (2013.01); *H01H 13/36* (2013.01); *H01H 3/122* (2013.01); *H01H 13/52* (2013.01); *H01H 25/008* (2013.01); *H01H 25/041* (2013.01)

(58) Field of Classification Search

CPC .... H01H 25/041; H01H 25/008; H01H 13/70; H01H 2221/044; H01H 23/30; H01H 19/635; H01H 21/245

USPC ..... 200/344, 290, 339, 4

See application file for complete search history.

(56) References Cited

U.S. PATENT DOCUMENTS

| | | | | |
|---|---|---|---|---|
| 5,698,825 | A * | 12/1997 | Karasik | H01H 25/041 200/5 A |
| 6,570,106 | B1 * | 5/2003 | Merrick | H01H 25/041 200/1 R |
| 6,657,141 | B1 * | 12/2003 | Myojin | H01H 25/008 200/4 |
| 2015/0380184 | A1 * | 12/2015 | Kuo | H01H 13/14 200/341 |
| 2016/0064162 | A1 * | 3/2016 | Kuo | H01H 3/122 200/341 |

* cited by examiner

*Primary Examiner* — Renee S Luebke
*Assistant Examiner* — Ahmed Saeed
(74) *Attorney, Agent, or Firm* — Trop Pruner & Hu, P.C.

(57) ABSTRACT

A pushbutton switch includes a pushbutton unit and a resilient member. The pushbutton unit includes a mounting seat and a pushbutton covering the mounting seat. The resilient member has a switch contactor, two resilient arms extending respectively from opposite ends of the switch contactor, two abutment segments engaging the limiting seat, and four sustainment segments extending away from the abutment segments and inclined toward the switch contactor. When the pushbutton is pressed to push the sustainment segments, the resilient arms are deformed to have a resilient force for urging the pushbutton away from the limiting seat, and to drive the switch contactor to contact and move an activator of a switch assembly.

10 Claims, 19 Drawing Sheets

PUSHBUTTON SWITCH

CROSS-REFERENCE TO RELATED APPLICATION

This application claims priority of Taiwanese Application No. 103135030, filed on Oct. 8, 2014.

FIELD

The disclosure relates to a pushbutton switch, and more particularly to a pushbutton switch having a resilient member.

BACKGROUND

Referring to FIGS. 1 and 2, a first conventional pushbutton switch 1 is suited for a switch assembly (not shown). The first conventional pushbutton switch 1 includes a mount seat 11, a pushbutton 12 that covers the mount seat 11 and cooperates with the mount seat 11 to define a receiving space 13, and a spring 14 that is disposed inside the receiving space 13. The spring 14 has two opposite ends that respectively abut against the mount seat 11 and the pushbutton 12, and urges the pushbutton 12 to move away from the mount seat 11.

Referring to FIGS. 3 and 4, in order to activate the switch assembly, the pushbutton 12 is pushed to be in proximity to the mount seat 11, thereby causing compression of the spring 14. However, since the spring 14 only contacts a center portion of the pushbutton 12, when an external force is exerted at a corner of the pushbutton 12, the external force may not be effectively transmitted to the spring 14. As such, actuation of the switch assembly may be hampered by inefficient compression of the spring 14.

Referring to FIGS. 5 and 6, a second conventional pushbutton switch 1' for connection with a switch assembly (not shown) includes a pushbutton 12, a mount seat 11 that is covered by the pushbutton 12, and four springs 14 that are respectively disposed below four corners of the pushbutton 12. However, since the springs 14 are independent from each other, when one of the corners of the pushbutton 12 is pressured by an external force, only a corresponding one of the springs 14 is compressed by the external force. That is to say, the external force is unable to be transmitted to the rest of the springs 14 under the foregoing situation. As a result, the actuation of the switch assembly (not shown) is still hampered.

In addition, in order to actuate the switch assembly (not shown), the pushbutton 12 of each of the first and second conventional pushbutton switches 1, 1' further includes a contact member 15 that extends from an inner surface of the pushbutton 12 for making electrical contact with the switch assembly when the pushbutton 12 is pushed to be in proximity to the mount seat 11. Accordingly, when the pushbutton 12 is moved toward the mount seat 11, the contact member 15 is moved together with the pushbutton 12 to actuate the switch assembly (not shown). However, the spring 14 and the contact member 15 of the conventional push button switches 1, 1' confer a relatively complicated structure and a relatively high manufacturing cost to the conventional push button switches 1,1'.

SUMMARY

Therefore, an object of the present disclosure is to provide a pushbutton switch that can alleviate at least one of the drawbacks of the prior arts.

According to one aspect of the present disclosure, the pushbutton switch is adapted to be connected to an activator of a switch assembly. The pushbutton switch includes a pushbutton unit and a resilient member.

The pushbutton unit includes a limiting seat and a pushbutton. The limiting seat is adapted to be disposed in proximity to the activator. The pushbutton covers the limiting seat and cooperates with the limiting seat to define a receiving space.

The resilient member is disposed in the receiving space, and has a switch contactor, two resilient arms, two abutment segments and four sustainment segments. The switch contactor is adapted to be adjacent to the activator, and has opposite ends spaced apart from each other in an extending direction. The resilient arms extend respectively from the opposite ends of the switch contactor. The abutment segments are respectively connected to the resilient arms, and engage the limiting seat. Two of the sustainment segments are connected to one of the resilient arms, extend away from a respective one of the abutment segments toward the pushbutton, are inclined toward the switch contactor, and are spaced apart from each other in a transverse direction transverse to the extending direction. The other two of the sustainment segments are connected to the other one of the resilient arms, extend away from the other one of the abutment segments toward the pushbutton, are inclined toward the switch contactor, and are spaced apart from each other in the transverse direction.

When the pushbutton is pressed to push the sustainment segments, the resilient arms are resiliently deformed to have a resilient force for urging the pushbutton away from the limiting seat, and to drive the switch contactor to contact and move the activator.

Another object of the present disclosure is to provide a resilient member adapted for use in a pushbutton switch. The pushbutton switch is connected to an activator of a switch assembly, and includes a limiting seat that is disposed in proximity to the activator, and a pushbutton that covers the limiting seat and that cooperates with the limiting seat to define a receiving space. The resilient member is disposed in the receiving space, and includes a switch contactor, two resilient arms, two abutment segments and four sustainment segments.

The switch contactor is adapted to be disposed adjacent to the activator, and has opposite ends spaced apart from each other in an extending direction.

The resilient arms extend respectively from the opposite ends of the switch contactor.

The abutment segments are respectively connected to the resilient arms, and engage the limiting seat.

Two of the sustainment segments are connected to one of the resilient arms, are adapted to extend away from a respective one of the abutment segments toward the pushbutton, are inclined toward the switch contactor, and are spaced apart from each other in a transverse direction transverse to the extending direction. The other two of the sustainment segments are connected to the other one of the resilient arms, are adapted to extend away from the other one of the abutment segments toward the pushbutton, are inclined toward the switch contactor, and are spaced apart from each other in the transverse direction.

When the pushbutton is pressed to push the sustainment segments, the resilient arms are resiliently deformed to have a resilient force adapted for urging the pushbutton away from the limiting seat, and to drive the switch contactor to contact and move the activator.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
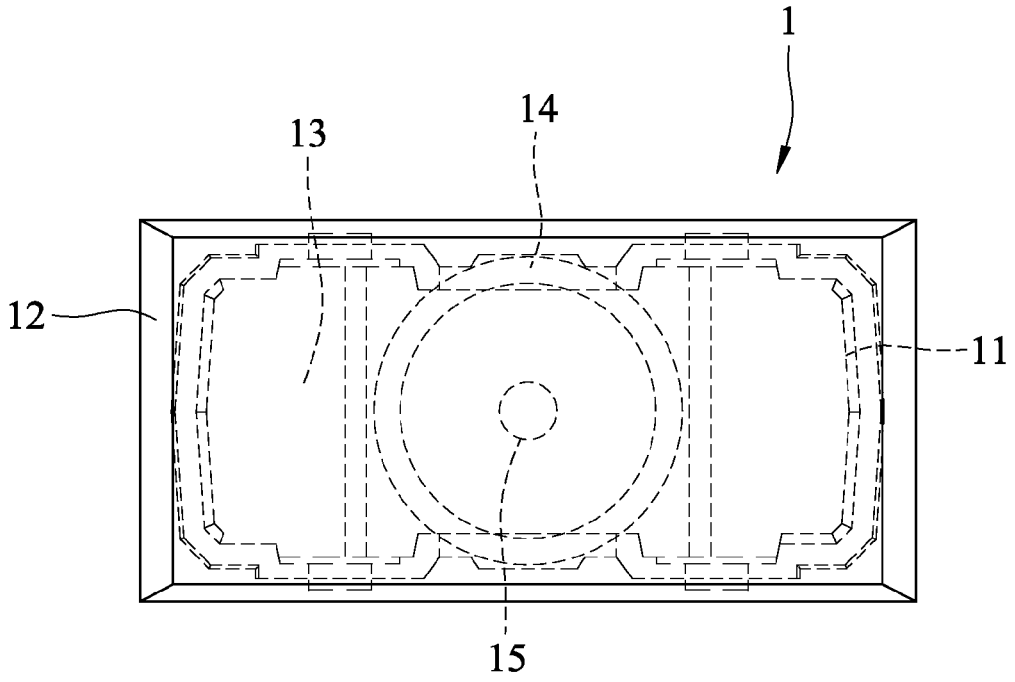
FIG.1 PRIOR ART
FIG. 1 is a top view illustrating a first conventional pushbutton switch.
Figure 2:
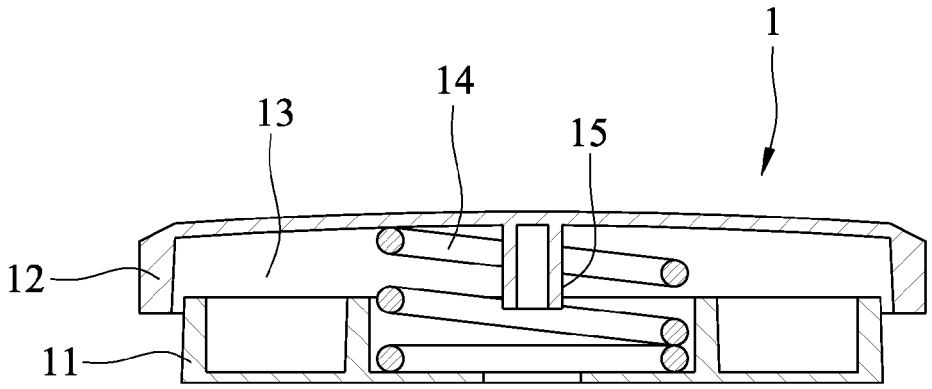
FIG.2 PRIOR ART
FIG. 2 is a sectional view of the first conventional pushbutton switch before a pushbutton is pressed.
Figure 3:
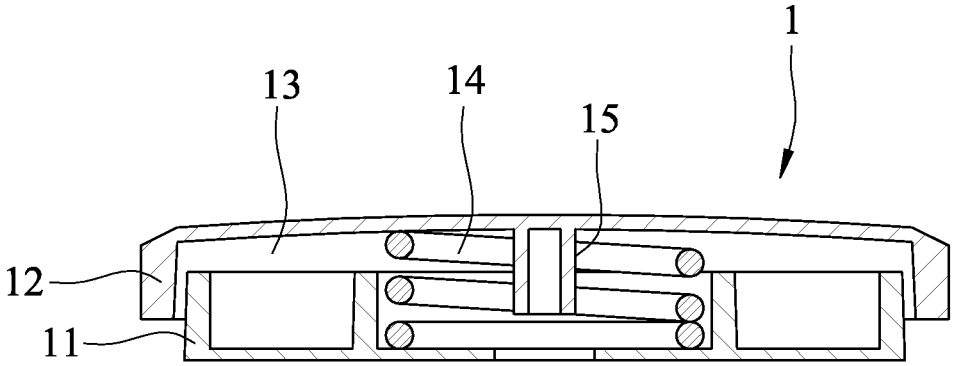
FIG.3 PRIOR ART
FIG. 3 is a sectional view of the first conventional pushbutton switch when the pushbutton is pressed.
Figure 4:
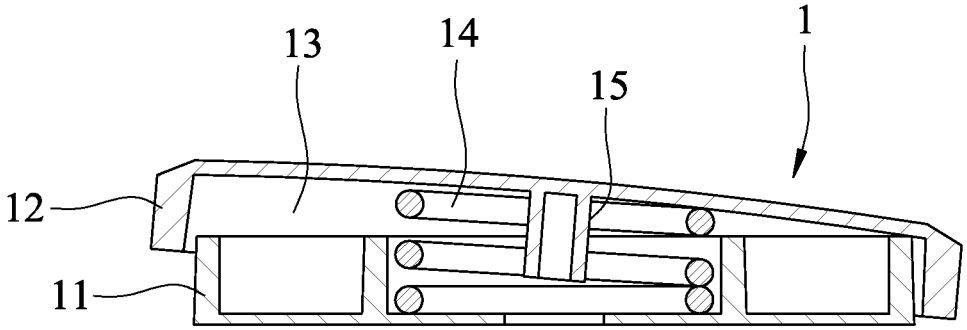
FIG.4 PRIOR ART
FIG. 4 is a sectional view of the first conventional pushbutton switch when a corner of the pushbutton is pressed.
Figure 5:
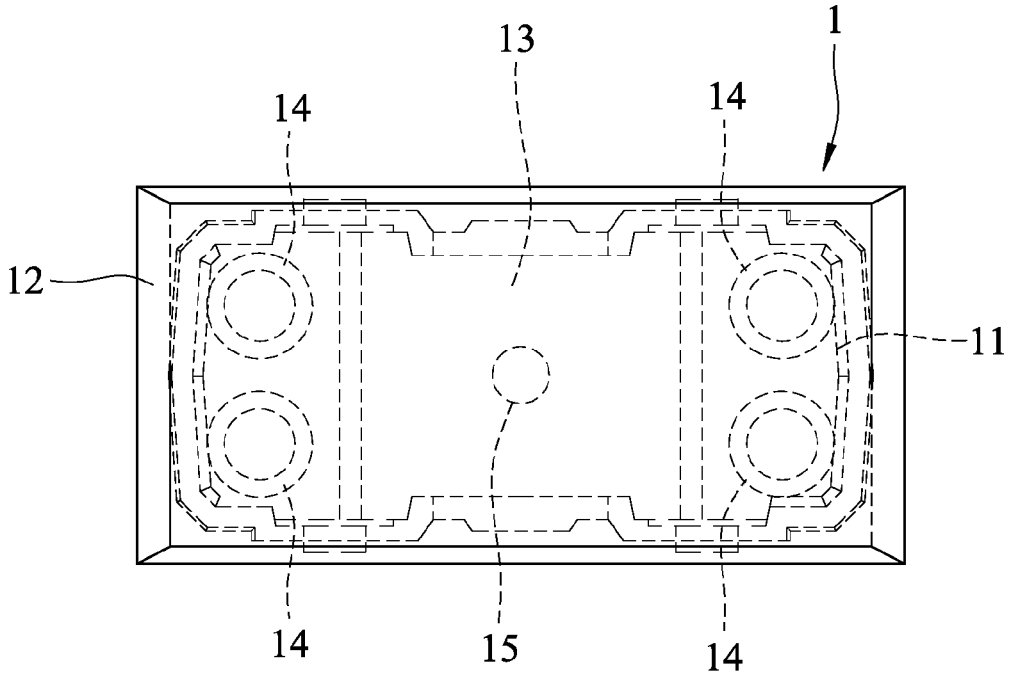
FIG.5 PRIOR ART
FIG. 5 is a top view illustrating a second conventional pushbutton switch.
Figure 6:
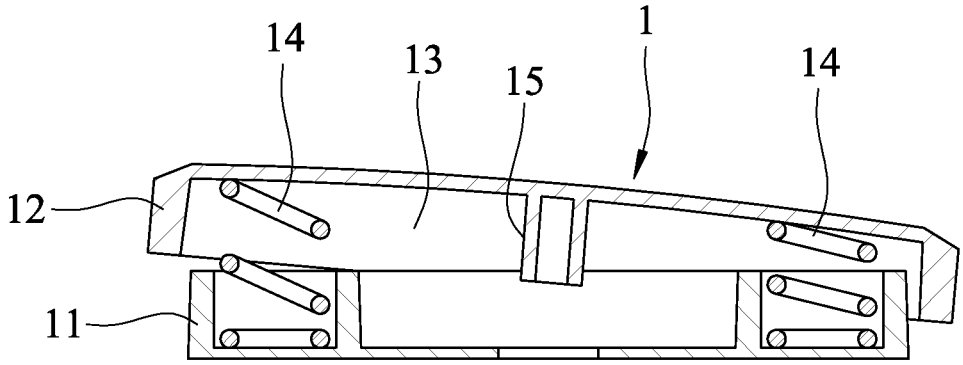
FIG.6 PRIOR ART
FIG. 6 is a sectional view of the second conventional pushbutton switch when a corner of a pushbutton is pressed.
Figure 7:
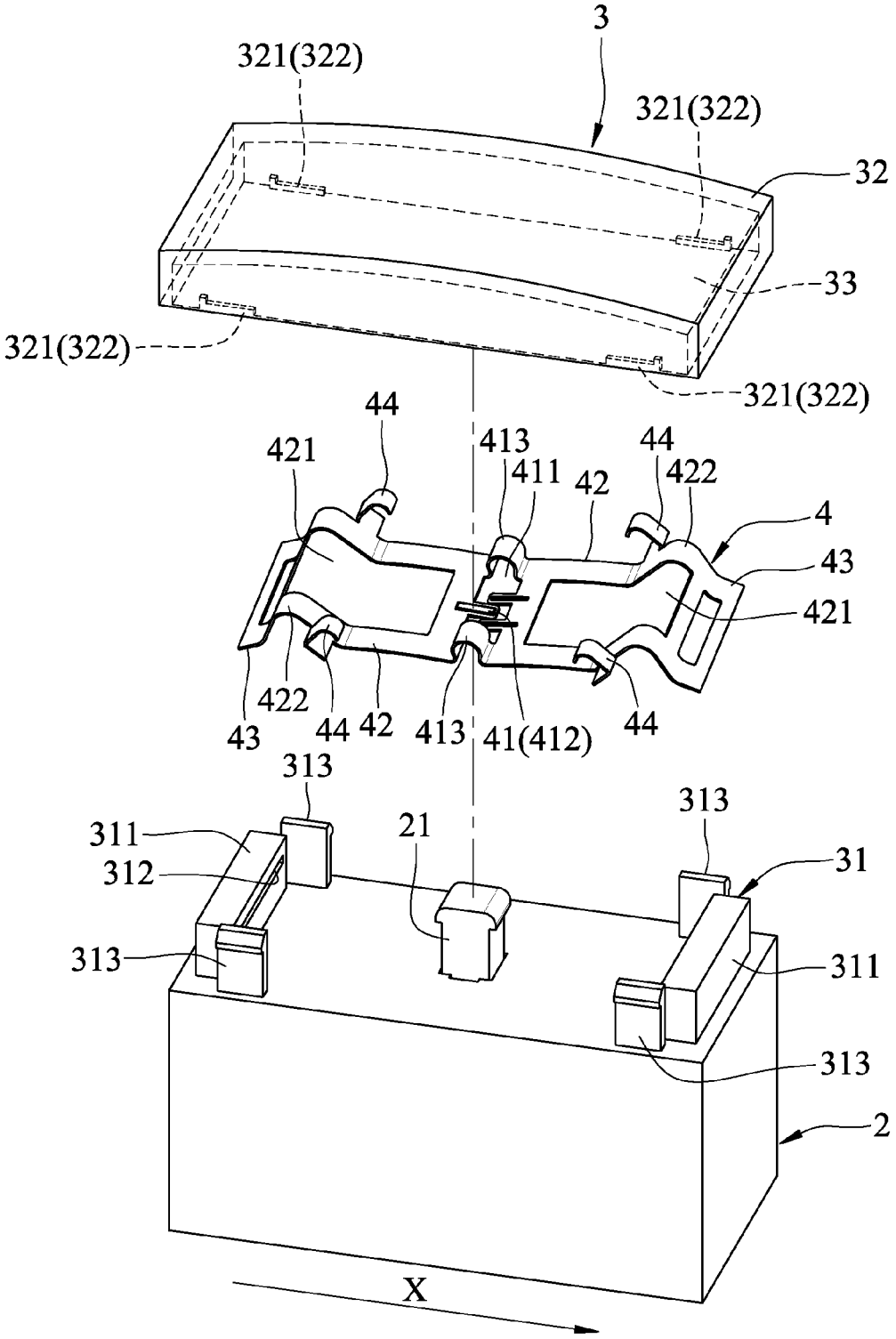
FIG. 7 is an exploded perspective view illustrating the first embodiment of a pushbutton switch according to the present disclosure.

Before the pre sent disclosure is described in greater detail, it should be noted that like elements are denoted by the same reference numerals throughout the disclosure.

Referring to FIGS. 7 to 12, the first embodiment of a pushbutton switch according to the present disclosure is suitable for a switch assembly 2. The switch assembly 2 includes an activator 21.

The pushbutton switch includes a pushbutton unit 3 and a resilient member 4.

In this embodiment, the pushbutton unit 3 includes a mounting seat 31 that is adapted to be disposed in proximity to the activator 21, and a pushbutton 32 that covers the limiting seat 31 and that cooperates with the limiting seat 31 to define a receiving space 33.

The limiting seat 31 includes two seat blocks 311 and four limiting portions 313. The seat blocks 311 are adapted to be disposed respectively at two opposite sides of the activator 21 in an extending direction (X). Each of the seat blocks 311 is formed with a sliding groove 312 that opens toward the activator 21. In this embodiment, two of the limiting portions 313 are spaced apart from each other in a transverse direction transverse to the extending direction (X), and flank one of the seat blocks 311. The other two of the limiting portions 313 are spaced apart from each other in the transverse direction and flank the other one of the seat blocks 311.

In this embodiment, each of the limiting portions 313 is configured as a hook. The limiting seat 31 and the switch assembly 2 are integrally formed as one piece. However, in other embodiments, the limiting seat 31 and the switch assembly 2 may be individually formed and coupled together.

The pushbutton 32 has a top wall, a surrounding wall extending from the top wall and surrounding the receiving space 33, and four locking portions 321 that are disposed on an inner surface of the surrounding wall. Each of the locking portions 321 has an L-shaped protrusion 322 that engages a respective one of the limiting portions 313 of the limiting seat 31 to lock the pushbutton 32 to the limiting seat 31, and to prevent movement of the pushbutton 32 in the extending direction (X) relative to the limiting seat 31.

In this embodiment, the resilient member 4 is disposed in the receiving space 33, and has a switch contactor 41, two resilient arms 42, two abutment segments 43 and four sustainment segments 44.

Figure 8:
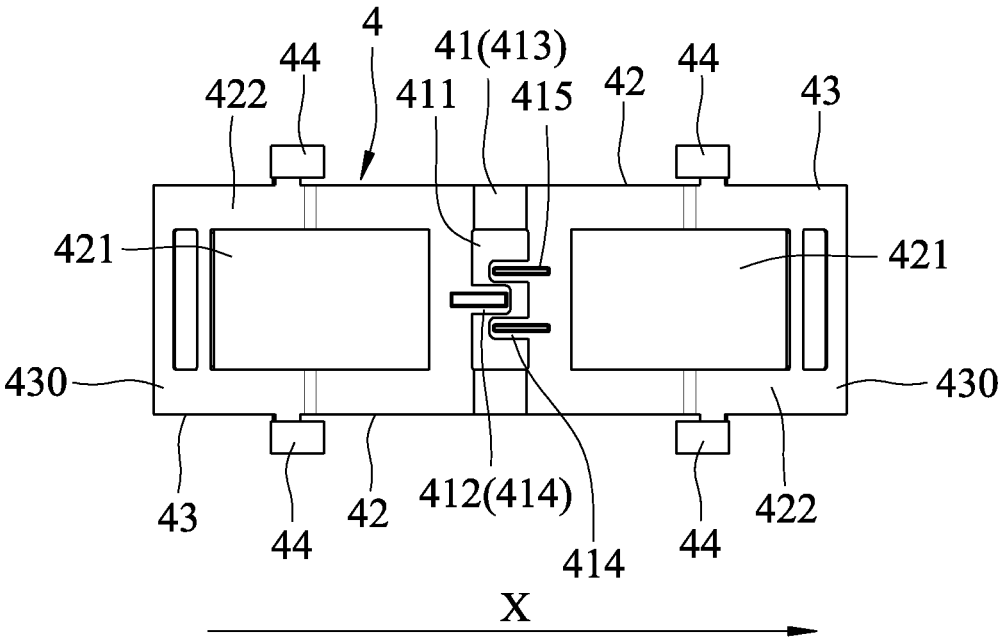
FIG. 8 is a top view of a resilient member of the first embodiment.
Figure 10:
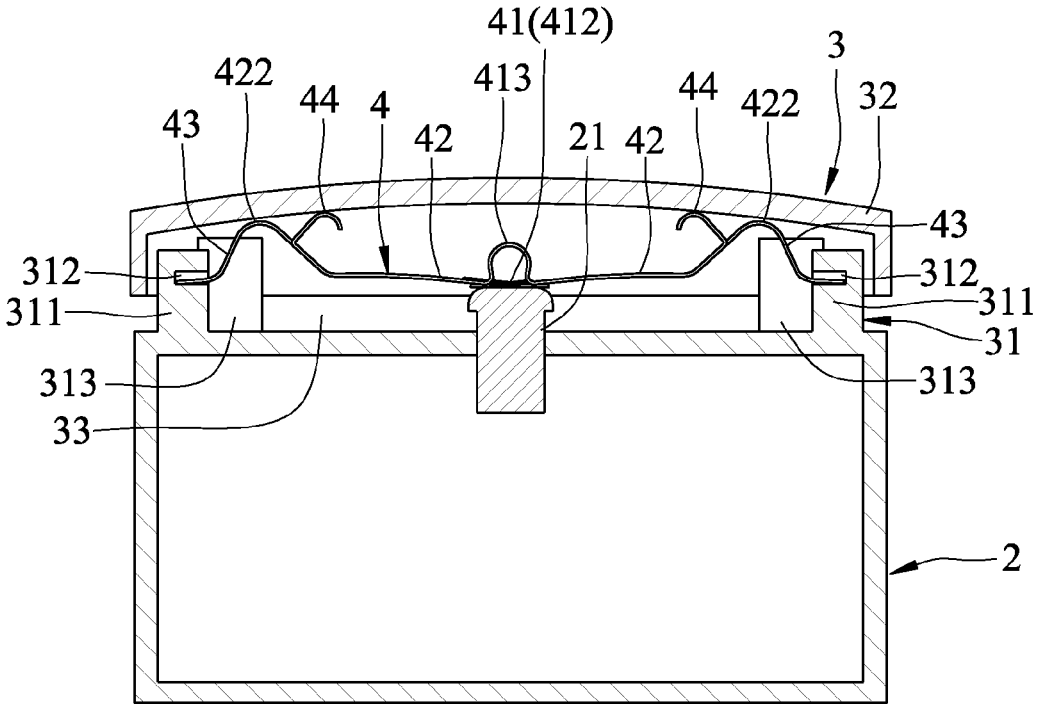
FIG. 10 is a fragmentary perspective view illustrating the resilient member of the first embodiment when a corner of the pushbutton is pressed.

The switch contactor 41 is adapted to be disposed adjacent to the activator 21, and has opposite ends spaced apart from each other in the extending direction (X). As shown in FIGS. 8 and 10, the switch contactor 41 further has a void 411 that is formed at a center thereof, a contact unit 412 and two linking portions 413. The contact unit 412 is disposed in the void 411, and is connected to one of the resilient arms 42. The linking portions 413 are spaced apart from each other in the transverse direction and are separated by the void 411. Each of the linking portions 413 has a drop-shaped cross-section (see FIG. 10) that extends toward the pushbutton 32. Specifically, the linking portions 413 interconnect the resilient arms 42 for force transmission between the resilient arms 42 so as to enhance force sensitivity of the resilient member 4.

In this embodiment, the contact unit 412 has three rib plates 414 that are arranged in the transverse direction. One of the rib plates 414 is connected to one of the resilient arms 42, the other two of the rib plates 414 are disposed at opposite sides of the one of the rib plates 414, and are connected to the other one of the resilient arms 42. However, in other embodiments of the pushbutton switch, the number of the rib plates 414 may vary. In addition, each of the rib plates 414 has a protrusion 415 extending toward the pushbutton 32 for reinforcing the structural strength of the contact unit 412.

The resilient arms 42 extend respectively from the opposite ends of the switch contactor 41. As shown in FIGS. 9 to 12, each of the resilient arms 42 is curved, has a distal end portion 422 that extends toward the pushbutton 32, and is formed with an opening 421.

The abutment segments 43 are respectively connected to the resilient arms 42, and respectively engage the seat blocks 311 of the limiting seat 31. Specifically, each of the abutment segments 43 extends from the distal end 422 of a respective one of the resilient arms 42, and has a sliding section 430 slidably inserted into the sliding groove 312 of a respective one of the seat blocks 311. As such, the sliding section 430 of each of the abutment segments 43 is slidable relative to the limiting seat 31 when the respective one of the resilient arms 42 is deformed (see FIGS. 10 and 11).

Two of the sustainment segments 44 are connected to one of the resilient arms 42, extend away from a respective one of the abutment segments 43 toward the pushbutton 32, are inclined toward the switch contactor 41 and are spaced apart from each other in the transverse direction. Specifically, the two of the sustainment segments 44 are connected respectively to opposite edges of the one of the resilient arms 42 in the transverse direction. The other two of the sustainment segments 44 are connected to the other one of the resilient arms 42, extend away from the other one of the abutment segments 43 toward the pushbutton 32, are inclined toward the switch contactor 41, and are spaced apart from each other in the transverse direction. Specifically, the other two of the sustainment segments 44 are connected respectively to opposite edges of the other one of the resilient arms 42 in the transverse direction.

Figure 9:
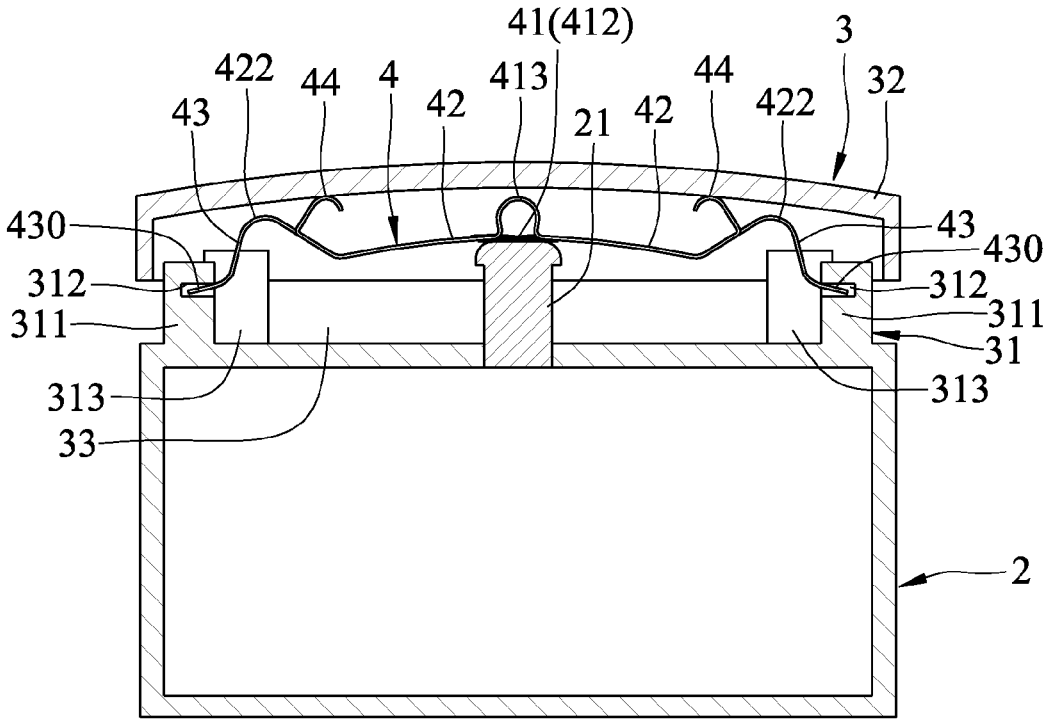
FIG. 9 is a sectional view of the first embodiment before a pushbutton is evenly pressed.

Referring to FIGS. 9 and 10, when the pushbutton 32 is pressed to push the sustainment segments 44, the sustainment segments 44 slide against an inner surface of the top wall of the pushbutton 32, and the resilient arms 42 are resiliently deformed to have a resilient force for urging the pushbutton 32 away from the limiting seat 31 and to drive the switch contactor 41 to contact and move the activator 21, such that the switch assembly 2 is actuated (as shown in FIG. 10). The sliding movement of the sliding section 430 of each of the abutment segments 43 would be stopped by a groove-defining surface which defines the sliding groove 312 of a respective one of the seat blocks 311 so as to arrest deformation of the resilient arms 42.

Figure 11:
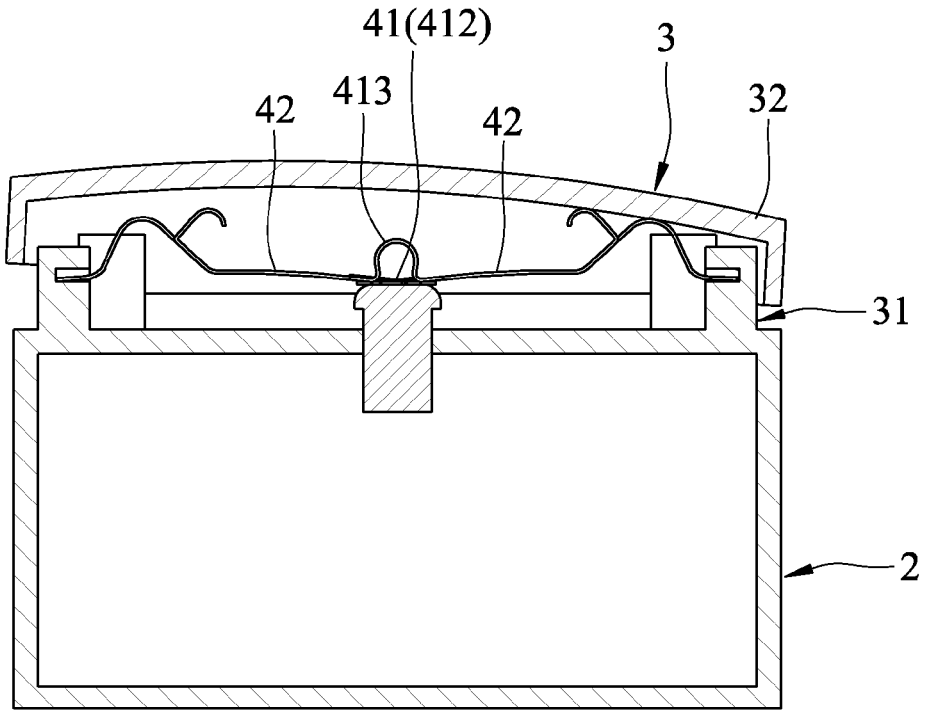
FIG. 11 is a sectional view of the first embodiment when the pushbutton is laterally pressed.

Referring to FIG. 11, when an external force is applied to one side of the pushbutton 32 that corresponds to a respective one of the resilient arms 42, the respective one of the resilient arms 42 is first deformed. By virtue of the linking portions 413 of the switch contactor 41 interconnecting the resilient arms 42, the other one of the resilient arms 42 would be subsequently driven to deform, thereby enhancing touch sensitivity of the switch assembly 2. Accordingly, the external force can be uniformly transmitted over the resilient member 4 regardless of where the external force acts on the pushbutton 32.

Figure 12:
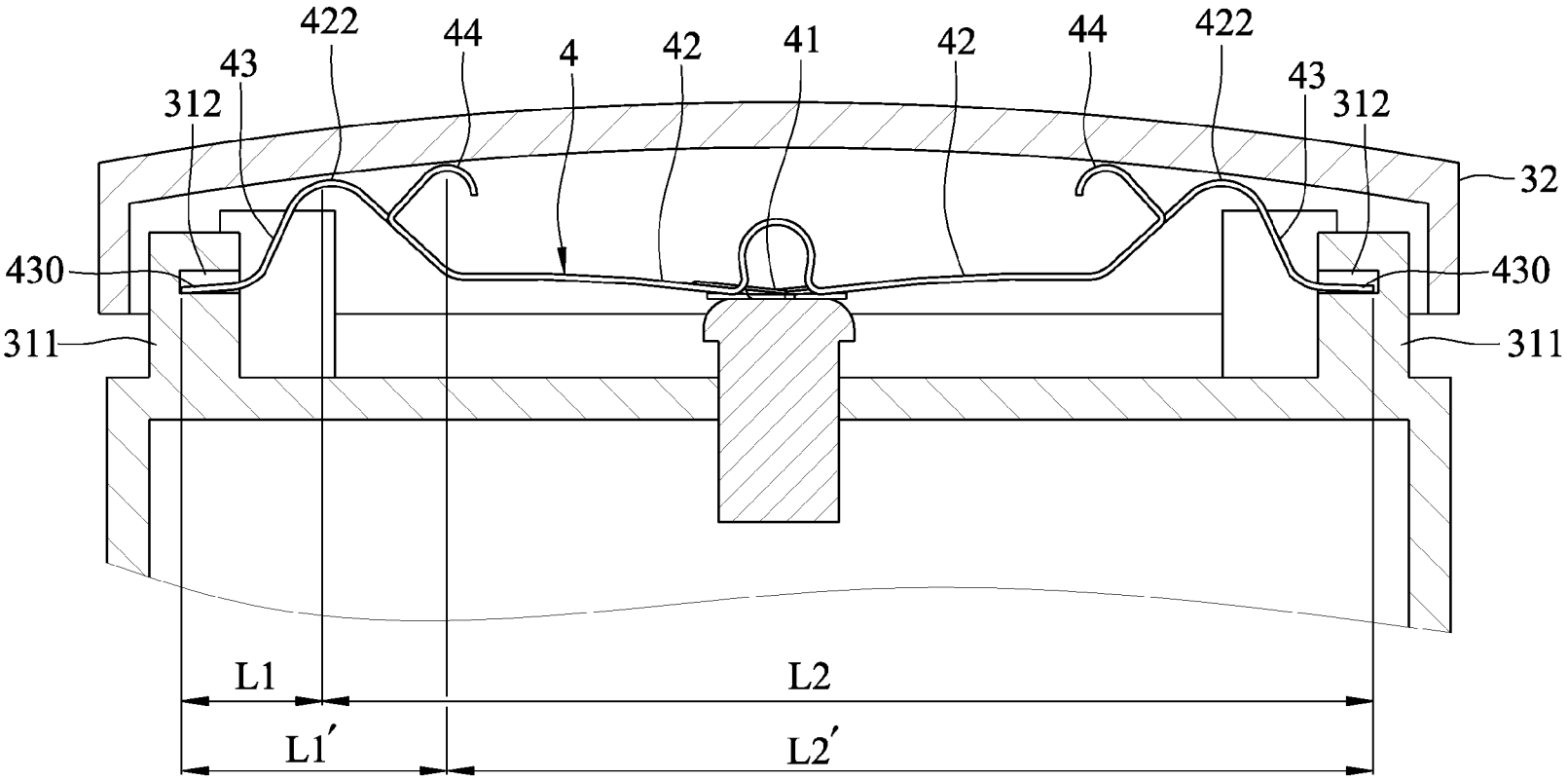
FIG. 12 is a fragmentary sectional view of the first embodiment.

The sustainment segments 44 can further increase the touch sensitivity of the resilient member 4. As shown in FIG. 12, if the sustainment segments 44 are omitted from the resilient member 4, the pushbutton 32 will directly push the distal end portions 422 of the resilient arms 42 when being pressed. For example, when the external force is applied to a left side of the pushbutton 32, the total moment exerted on the resilient member 4 is established with a moment arm (L1) measured in the extending direction (X) between the sliding section 430 of the left one of the abutment segments 43 (which serves as a fulcrum) and the distal end portion 422 of the left one of the resilient arms 42, and another moment arm (L2) which is significantly longer than the moment arm (L1) measured in the extending direction (X) between the sliding section 430 of the right one of the abutment segments 43 (which serves as a fulcrum) and the distal end portion 422 of the right one of the resilient arms 42. In this embodiment, by virtue of the sustainment segments 44, the total moment exerted on the resilient member 4 is established with a moment arm (L1') measured in the extending direction (X) between the sliding section 430 of the left one of the abutment segments 43 and the left one of the sustainment segments 44, and another moment arm (L2') measured in the extending direction (X) between the sliding section 430 of the right one of the abutment segment 43 and the right one of the sustainment segments 44. It is shown in FIG. 12 that, the length of the moment arm (L1') is twice as long as the moment arm (L1), while the length of the moment arm (L2')is 0.9 times the length of the moment arm (L2) . Therefore, under the same external force exerted on the resilient member 4, the total moment applied to the resilient member 4 with the presence of the sustainment segments 44 is larger than that with the omission of the sustainment segments 44, thereby resulting in greater deformation of the resilient arms 42.

Referring back to FIGS. 9 and 10, in this embodiment, the switch assembly 2 further includes a restoring mechanism (not shown) for automatically restoring the activator 21 to the normal position. When the pushbutton 32 is released, not only can the resilient force of the resilient arms 42 urge the pushbutton 32 away from the limiting seat 31, but the activator 21 is also moved by the restoring mechanism together with the pushbutton 32.

Figure 13:
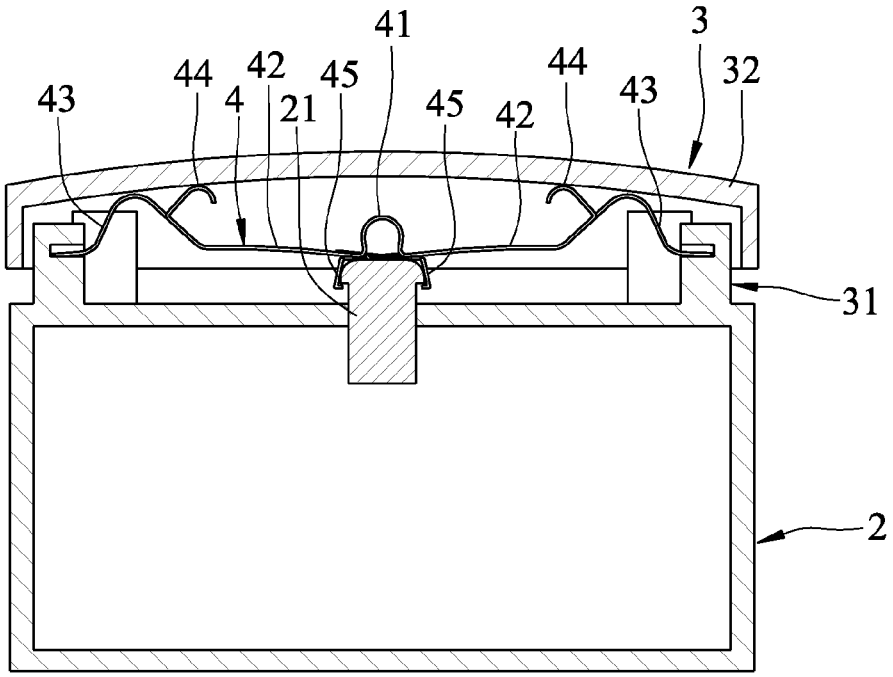
FIG. 13 is a sectional view of a modification of the first embodiment.

FIG. 13 illustrates a modification of the switch assembly 2 in which the restoring mechanism is omitted and the resilient member 4 further has a clip segment 45. The clip segment 45 is connected to the switch contactor 41 and is adapted to clip the activator 21. Therefore, when the pushbutton 32 is released, the resilient force of the resilient arms 42 can restore the activator 21 as well.

In view of the above, the pushbutton switch has the following advantages:

1. Since the resilient member 4 serves not only to move the activator 21 when the pushbutton 32 is pressed but also to restore the pushbutton 32 when the pushbutton 32 is released, the pushbutton switch of this disclosure has a simplified structure.

2. By virtue of the resilient member 4, an external force for pushing the pushbutton 32 can be uniformly transmitted through the resilient member 4, thereby enhancing smoothness in pressing of the pushbutton 32. Since the sustainment segments 44 are inclined toward the switch contactor 41, touch sensitivity of the resilient member 4 can be further increased.

3. Since the resilient member 4 is formed into one piece, and since the linking portions 413 of the switch contactor 41 interconnect the resilient arms 42, the resilient arms 42 can interact with each other. In other words, when one of the resilient arms 42 is deformed, the other one of the resilient arms 42 is affected to be deformed as well. As such, the resilient member 4 has relatively enhanced force sensitivity for uniformly distributing force regardless of where the external force acts on the pushbutton 32.

Figure 14:
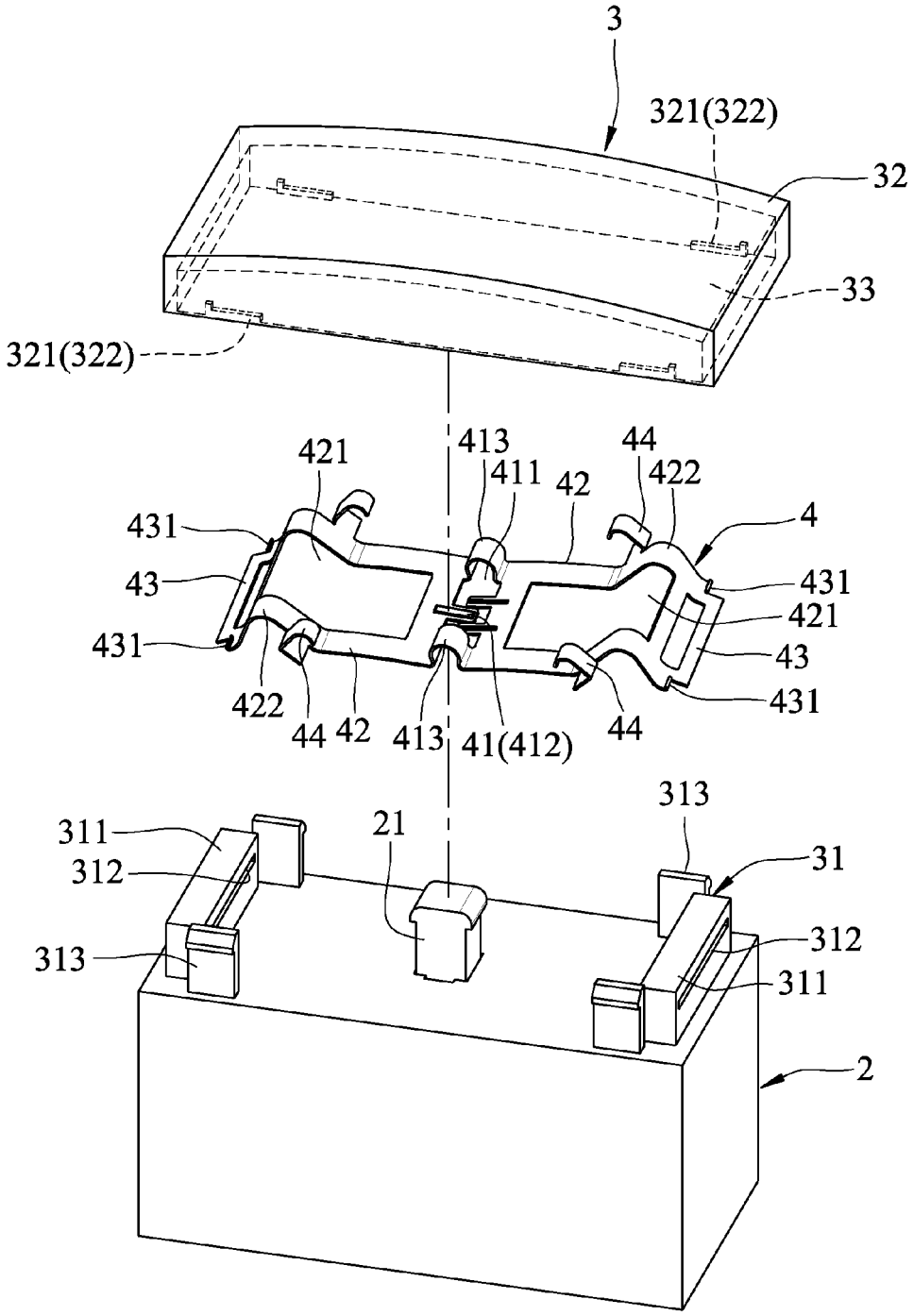
FIG. 14 is an exploded perspective view illustrating the second embodiment of a pushbutton switch according to the present disclosure.
Figure 15:
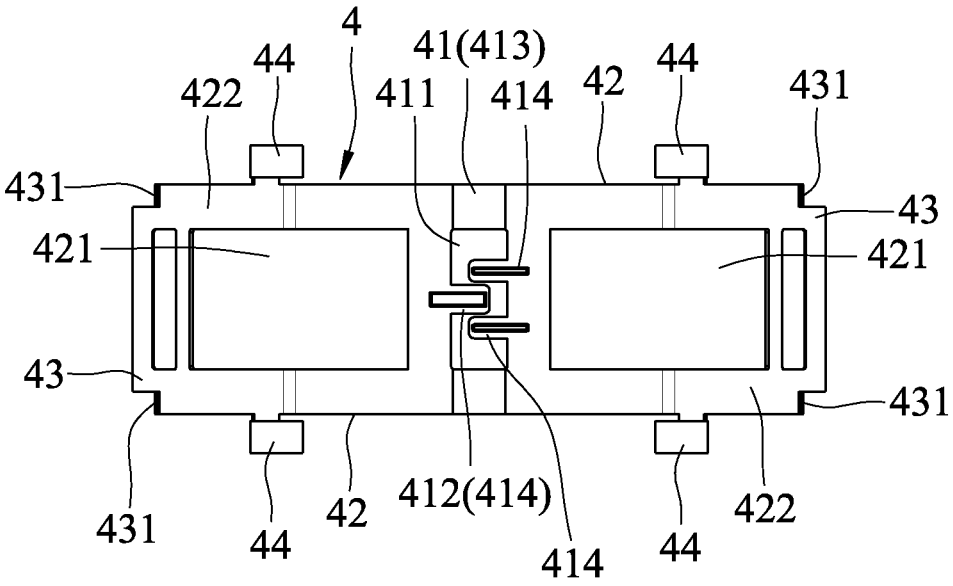
FIG. 15 is a top view of the resilient member of the second embodiment.
Figure 16:
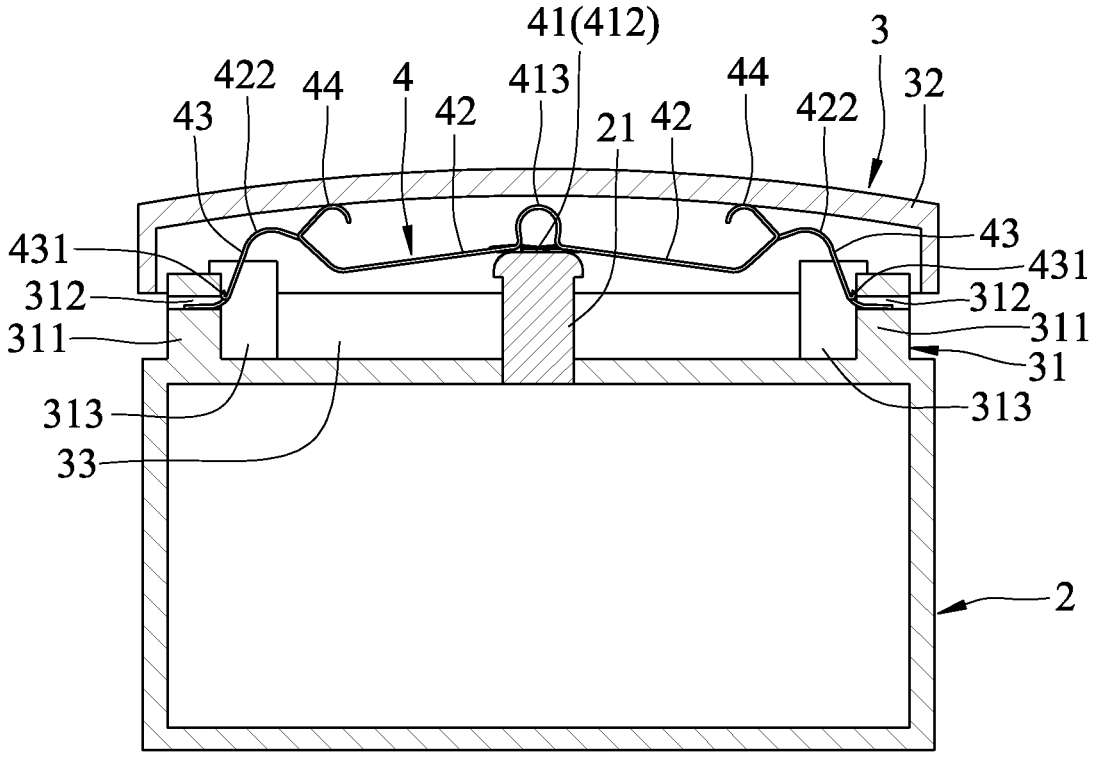
FIG. 16 is a sectional view of the second embodiment.

FIGS. 14 to 15 illustrate the second embodiment of a pushbutton switch according to the present disclosure, which has a configuration similar to that of the first embodiment. Some differences between the first and second embodiments are depicted hereinafter.

In this embodiment, the sliding grooves 312 respectively extend through the seat blocks 311 in the extending direction (X).

Each of the abutment segments 43 further has two stopper sections 431 that are disposed in proximity to the sliding-section 430 for abutting against a respective one of the seat blocks 311 to arrest the sliding movement of the sliding section 430 relative to the respective one of the seat blocks 311. Specifically, for each of the abutment segments 43 of the resilient member 4, the stopper sections 431 are connected respectively to two outer side edges of the sliding section 430 and are spaced apart from each other in the transverse direction.

Figure 17:
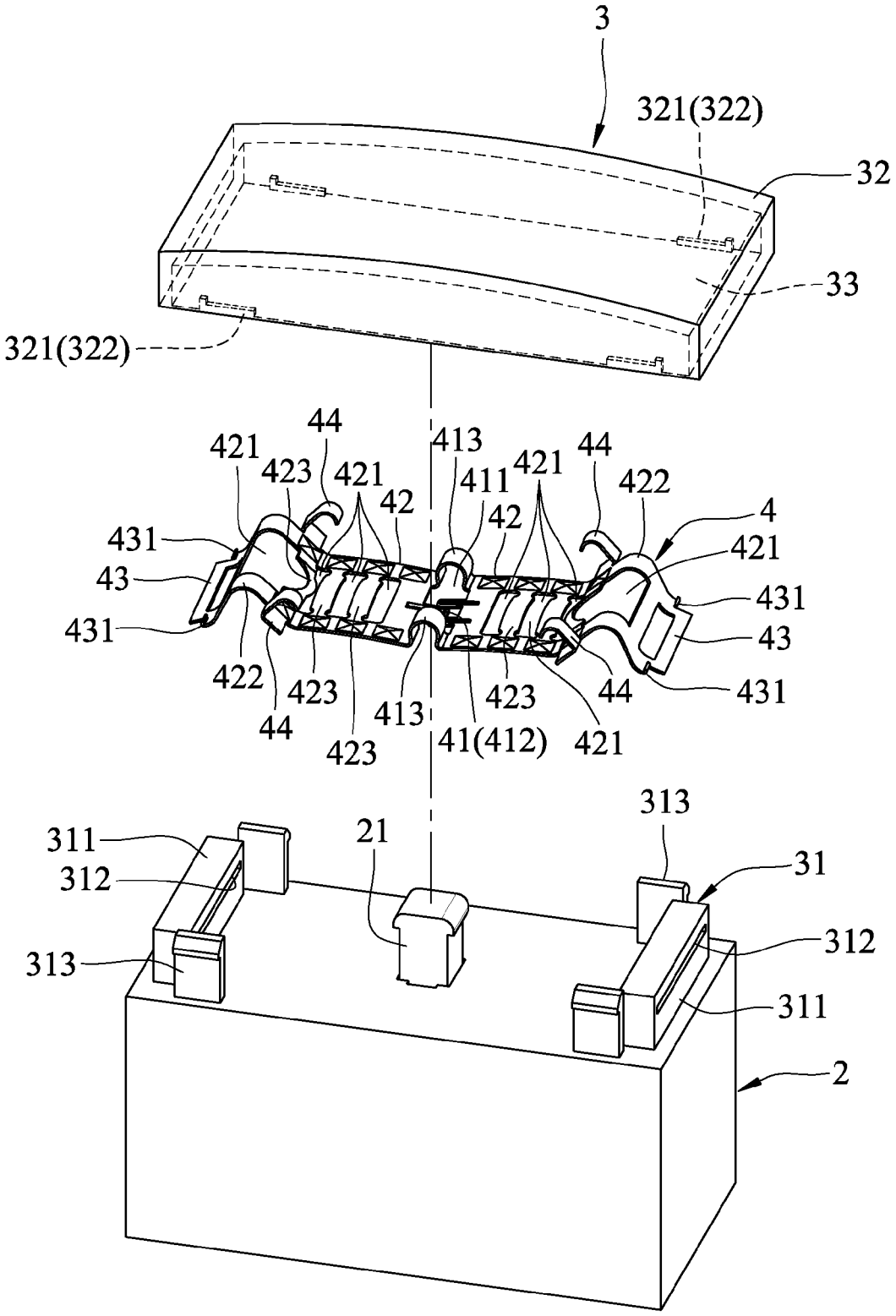
FIG. 17 is an exploded perspective view illustrating the third embodiment of a pushbutton switch according to the present disclosure.
Figure 18:
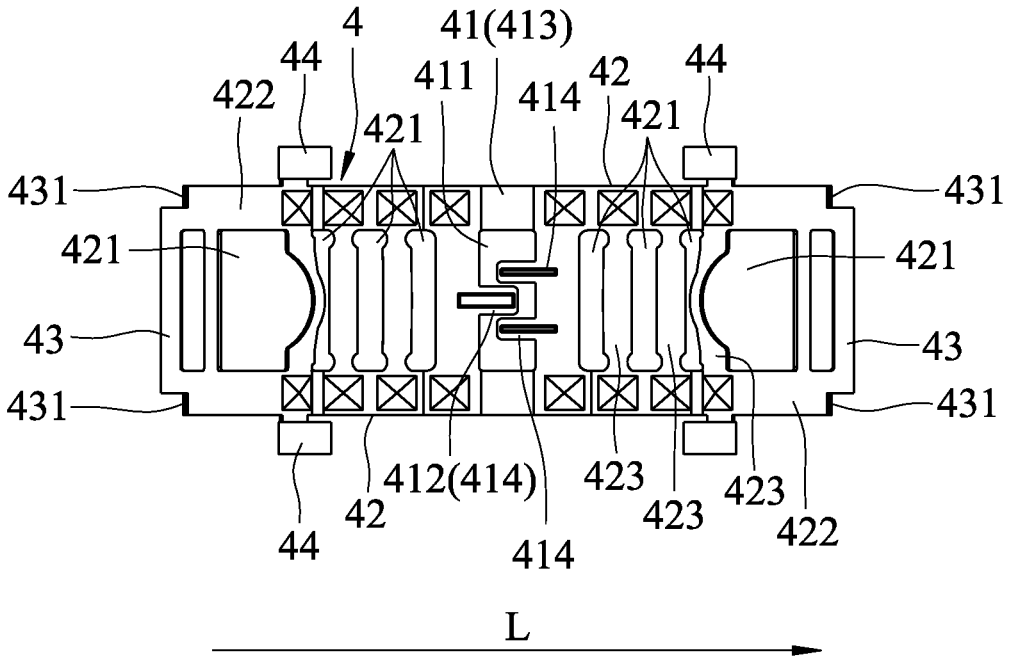
FIG. 18 is a top view of the resilient member of the third embodiment.
Figure 19:
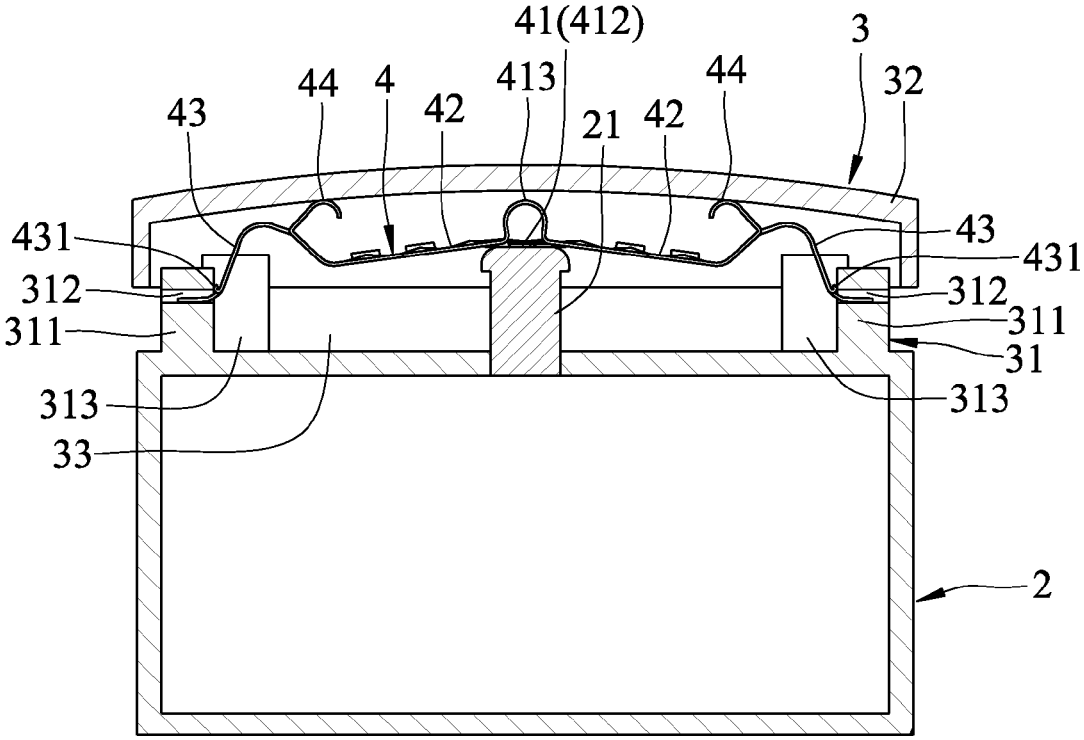
FIG. 19 is a sectional view of the third embodiment when the pushbutton is laterally pressed.

FIGS. 17 to 19 illustrate the third embodiment of a pushbutton switch according to the pre sent disclosure, which has a configuration similar to that of the second embodiment. Some differences between the first and third embodiments are depicted hereinafter.

In this embodiment, each of said resilient arms 42 has four of the openings 421 that are spaced apart from one another, that are arranged in the extending direction (X), and that divide the resilient arm 42 into three reinforcement portions 423. For each of the resilient arms 42, the reinforcement sections 423 are capable of distributing an external force exerted on any one of the sustainment segments 44 throughout the resilient member 4, thereby further increasing touch sensitivity of the switch assembly 2 and reinforcing the strength of the resilient arms 42.

While the present disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A pushbutton switch adapted to be connected to an activator of a switch assembly, comprising:

a pushbutton unit including a limiting seat that is adapted to be disposed in proximity to the activator, and a pushbutton that covers said limiting seat and that cooperates with said limiting seat to define a receiving space; and a resilient member disposed in said receiving space, and having a switch contactor that is adapted to be disposed adjacent to the activator, and that has opposite ends spaced apart from each other in an extending direction, two resilient arms that extend respectively from said opposite ends of said switch contactor, two abutment segments that are respectively connected to said resilient arms, and that engage said limiting seat, and four sustainment segments, two of said sustainment segments being connected to one of said resilient arms, extending away from a respective one of said abutment segments toward said pushbutton, being inclined toward said switch contactor and being spaced apart from each other in a transverse direction that is transverse to the extending direction, the other two of said sustainment segments being connected to the other one of said resilient arms, extending away from the other one of said abutment segments toward said pushbutton, being inclined toward said switch contactor and being spaced apart from each other in the transverse direction;

wherein, when said pushbutton is pressed to push said sustainment segments, said resilient arms are resiliently deformed to have a resilient force for urging said pushbutton away from said limiting seat, and to drive said switch contactor to contact and move the activator.

2. The pushbutton switch as claimed in claim 1, wherein said switch contactor further has:

a void that is formed at a center thereof; and a contact unit that is disposed in said void, and that is connected to one of said resilient arms.

3. The pushbutton switch as claimed in claim 2, wherein said switch contactor of said resilient member further has two linking portions that are spaced apart from each other in the transverse direction and that are separated by said void, each of said linking portions having a drop-shaped cross-section that extends toward said pushbutton.

4. The pushbutton switch as claimed in claim 2, wherein said contact unit has three rib plates that are arranged in the transverse direction, one of said rib plates being connected to one of said resilient arms, the other two of said rib plates being connected to the other one of said resilient arms.

5. The pushbutton switch as claimed in claim 1, wherein each of said resilient arms has at least one opening.

6. The pushbutton switch as claimed in claim 5, wherein each of said resilient arms has four of said openings that are spaced apart from one another, that are arranged in the extending direction, and that divide said resilient arm into three reinforcement portions.

7. The pushbutton switch as claimed in claim 1, wherein said limiting seat of said pushbutton unit includes two seat blocks that are spaced apart from each other in the extending direction, said abutment segments of said resilient member respectively engaging said seat blocks.

8. The pushbutton switch as claimed in claim 7, wherein each of said seat blocks of said limiting seat is formed with a sliding groove, each of said abutment segments of said resilient member being slidably inserted into said sliding groove of a respective one of said seat blocks.

9. The pushbutton switch as claimed in claim 8, wherein each of said abutment segments extends from a distal end portion of a respective one of said resilient arms, and has a sliding section that is inserted into said sliding groove of the respective one of said seat blocks, and that is slidable relative to the respective one of said seat blocks when the respective one of said resilient arms is deformed, and a stopper section that abuts against a respective one of said seat blocks to arrest the sliding movement of said sliding section relative to the respective one of said seat blocks.

10. A resilient member adapted for use in a pushbutton switch, the pushbutton switch being connected to an activator of a switch assembly, and including a limiting seat that is disposed in proximity to the activator, and a pushbutton that covers the limiting seat and that cooperates with the limiting seat to define a receiving space, said resilient member being disposed in the receiving space and comprising:

a switch contactor that is adapted to be disposed adjacent to the activator, and that has opposite ends spaced apart from each other in an extending direction;

two resilient arms that extend respectively from said opposite ends of said switch contactor;

two abutment segments that are respectively connected to said resilient arms, and that engage said limiting seat; and four sustainment segments, two of said sustainment segments being connected to one of said resilient arms, being adapted to extend away from a respective one of said abutment segments toward the pushbutton, being inclined toward said switch contactor, and being spaced apart from each other in a transverse direction that is transverse to the extending direction, the other two of said sustainment segments being connected to the other one of said resilient arms, being adapted to extend away from the other one of said abutment segments toward the pushbutton, being inclined toward said switch contactor, and being spaced apart from each other in the transverse direction;

wherein, when the pushbutton is pressed to push said sustainment segments, said resilient arms are resiliently deformed to have a resilient force adapted for urging the pushbutton away from the limiting seat, and to drive said switch contactor to contact and move the activator.

* * * * *